US009802789B2

(12) United States Patent
Kim et al.

(10) Patent No.: US 9,802,789 B2
(45) Date of Patent: Oct. 31, 2017

(54) ELEVATOR SECURITY SYSTEM

(71) Applicant: KT CORPORATION, Gyeonggi-do (KR)

(72) Inventors: Yu-Seon Kim, Seoul (KR); Eui-Seung Son, Incheon (KR); Ho-Sung Yoon, Daejeon (KR)

(73) Assignee: KT CORPORATION, Gyeonggi-do (KR)

( * ) Notice: Subject to any disclaimer, the term of this patent is extended or adjusted under 35 U.S.C. 154(b) by 440 days.

(21) Appl. No.: 14/525,404

(22) Filed: Oct. 28, 2014

(65) Prior Publication Data

US 2015/0114763 A1 Apr. 30, 2015

(30) Foreign Application Priority Data

Oct. 28, 2013 (KR) ..... 10-2013-0128639

(51) Int. Cl.
*B66B 1/20* (2006.01)
*B66B 5/00* (2006.01)
*B66B 1/34* (2006.01)

(52) U.S. Cl.
CPC ..... *B66B 5/0012* (2013.01); *B66B 1/3461* (2013.01)

(58) Field of Classification Search
CPC ..... B66B 5/0012; B66B 1/3461
USPC ..... 187/247, 277, 380–389, 391, 393, 396; 382/103–107; 340/3.1, 3.3, 5.1, 5.2, 5.21, 340/5.23, 5.28, 5.3, 5.31, 5.32, 5.61, 5.64, 340/5.8, 5.81, 6.1; 348/14.02, 14.03, 348/14.07, 14.09
See application file for complete search history.

(56) References Cited

U.S. PATENT DOCUMENTS

| | | | | |
|---|---|---|---|---|
| 4,780,706 | A | 10/1988 | Bollag | |
| 5,579,221 | A | 11/1996 | Mun | |
| 5,621,662 | A | 4/1997 | Humphries et al. | |
| 5,946,209 | A | 8/1999 | Eckel et al. | |
| 6,728,351 | B2 * | 4/2004 | Ahlstrom | H04M 11/025 379/102.06 |
| 6,792,319 | B1 | 9/2004 | Bilger | |
| 6,909,921 | B1 | 6/2005 | Bilger | |

(Continued)

FOREIGN PATENT DOCUMENTS

| | | | |
|---|---|---|---|
| EP | 2463798 | A1 | 6/2012 |
| EP | 2733636 | A1 | 5/2014 |

(Continued)

*Primary Examiner* — Anthony Salata
(74) *Attorney, Agent, or Firm* — IP Legal Services, LLC

(57) ABSTRACT

An elevator security procedure is performed according to a security level of an elevator of a building including a plurality of residence units through an elevator security system. The elevator security system includes home gateways respectively installed at the plurality of residence units and a server coupled to the home gateways. The server may analyze a comparison result of passenger information of passengers in the elevator and member information of members of residence units associated with floors selected by the passengers in the elevator. The server may determine a security level of the elevator based on the analysis result. The server may perform a security procedure designated for the determined security level by controlling at least one of constituent elements of the elevator and smart devices coupled to the at least one of home gateways.

18 Claims, 4 Drawing Sheets

(56) References Cited

U.S. PATENT DOCUMENTS

| | | | | |
|---|---|---|---|---|
| 7,093,693 | B1 * | 8/2006 | Gazdzinski | B66B 1/468 187/384 |
| 7,366,498 | B2 | 4/2008 | Ko et al. | |
| 7,398,860 | B2 * | 7/2008 | Amano | B66B 5/0018 187/247 |
| 7,461,723 | B2 * | 12/2008 | Kawai | B66B 5/024 187/313 |
| 7,774,527 | B2 | 8/2010 | Kim et al. | |
| 8,020,672 | B2 | 9/2011 | Lin et al. | |
| 8,061,485 | B2 * | 11/2011 | Finschi | B66B 1/468 187/384 |
| 8,138,882 | B2 | 3/2012 | Do et al. | |
| 8,401,781 | B2 | 3/2013 | Pazos et al. | |
| 8,413,767 | B2 * | 4/2013 | Nakashima | B66B 1/468 187/384 |
| 8,436,828 | B1 | 5/2013 | Zhai | |
| 8,467,911 | B2 | 6/2013 | Luo et al. | |
| 8,683,582 | B2 | 3/2014 | Rogers | |
| 8,813,917 | B2 * | 8/2014 | Salmikuukka | B66B 1/468 187/247 |
| 8,857,569 | B2 * | 10/2014 | Friedli | B66B 5/0012 187/384 |
| 8,976,248 | B2 * | 3/2015 | Tanaka | H04N 7/186 348/14.06 |
| 8,988,191 | B2 | 3/2015 | Zhang et al. | |
| 9,014,826 | B2 | 4/2015 | Yum et al. | |
| 9,055,621 | B2 | 6/2015 | Shrubsole | |
| 9,323,232 | B2 * | 4/2016 | Blom | G05B 13/00 |
| 9,382,096 | B2 * | 7/2016 | Finschi | B66B 1/468 |
| 2005/0009498 | A1 | 1/2005 | Ho et al. | |
| 2005/0151628 | A1 | 7/2005 | Becker et al. | |
| 2006/0005041 | A1 | 1/2006 | Lazeroms et al. | |
| 2007/0200658 | A1 | 8/2007 | Yang | |
| 2007/0263993 | A1 | 11/2007 | Kobayashi | |
| 2008/0191864 | A1 | 8/2008 | Wolfson | |
| 2009/0091529 | A1 | 4/2009 | Do et al. | |
| 2010/0162182 | A1 | 6/2010 | Oh et al. | |
| 2010/0194525 | A1 | 8/2010 | Do et al. | |
| 2010/0225443 | A1 | 9/2010 | Bayram et al. | |
| 2010/0289643 | A1 | 11/2010 | Trundle et al. | |
| 2011/0050394 | A1 | 3/2011 | Zhang et al. | |
| 2012/0086659 | A1 | 4/2012 | Perlin et al. | |
| 2014/0081433 | A1 | 3/2014 | Cheong et al. | |
| 2015/0018018 | A1 | 1/2015 | Shen et al. | |
| 2015/0039100 | A1 | 2/2015 | Yoshida et al. | |
| 2015/0039105 | A1 | 2/2015 | Lee | |
| 2015/0345065 | A1 | 12/2015 | Yang et al. | |

FOREIGN PATENT DOCUMENTS

| | | | |
|---|---|---|---|
| JP | 2007-290811 | A | 11/2007 |
| JP | 2009-208900 | A | 9/2009 |
| JP | 2011-153002 | A | 8/2011 |
| KR | 10-2005-0005869 | A | 1/2005 |
| KR | 10-2006-0066980 | A | 6/2006 |
| KR | 10-2006-0084165 | A | 7/2006 |
| KR | 10-0606760 | B1 | 7/2006 |
| KR | 10-2007-0074075 | A | 7/2007 |
| KR | 10-2008-0086206 | A | 9/2008 |
| KR | 10-0951716 | B1 | 4/2010 |
| KR | 10-0999084 | B1 | 12/2010 |
| KR | 10-2011-0042708 | A | 4/2011 |
| KR | 10-2013-0067852 | A | 6/2013 |
| WO | 2005/050580 | A2 | 6/2005 |

* cited by examiner

ELEVATOR SECURITY SYSTEM

CROSS REFERENCE TO PRIOR APPLICATIONS

The present application claims priority under 35 U.S.C. §119 to Korean Patent Application No. 10-2013-0128639 (filed on Oct. 28, 2013).

The subject matter of this application is related to U.S. patent application Ser. No. 14/481,878 (filed on Sep. 9, 2014), the teachings of which are incorporated herein in their entirety by reference.

BACKGROUND

The present disclosure relates to monitoring an enclosed area for security and, more particularly, to performing a security procedure based on a security level determined based on monitoring results of an elevator.

An elevator is a type of transport equipment that moves people or goods using electric power. An elevator is often referred as a lift. Elevators have become essential equipment in high-rise buildings and are now installed in most building, apartments, and other vertical structures. Although elevators are indispensable to many residents or occupants in buildings, crimes, including sexual harassment, have been committed in the elevators dues to its closed environment.

In order to prevent such crimes from being committed in the elevators, video recording devices like a closed-circuit television have been used. Even though some video recording devices provide real-time video footages to security personnel monitoring the elevator, an immediate response to a crime being committed in the elevators is not likely if the security personnel are not continuously watching the video footages. In other words, the video footages obtained from the video recording devices are mostly used in courts to prove the crimes, and there are limits to when using the video footages to prevent the crimes.

As a number of crimes committed in the elevators increases, family members of a woman or a child demand a way to check their safe returns to home. Monitoring the elevators from individual households is feasible, but not efficient, since a member of the household has to be continuously watching the inside of an elevator via a video recording device when another member of the household is returning to the home. A returning member may voluntarily act to alert his or her use of an elevator by calling or texting to another member, but this method is not efficient either.

SUMMARY

This summary is provided to introduce a selection of concepts in a simplified form that is further described below in the Detailed Description. This summary is not intended to identify key features or essential features of the claimed subject matter, nor is it intended to be used to limit the scope of the claimed subject matter.

Embodiments of the present invention overcome the above disadvantages and other disadvantages not described above. Also, the present invention is not required to overcome the disadvantages described above, and an embodiment of the present invention may not overcome any of the problems described above.

In accordance with an aspect of the present embodiment, a security procedure for an elevator may be performed according to a security level determined based on a monitoring result of the elevator.

In accordance with another aspect of the present embodiment, a stranger and an abnormal event in an elevator may be detected and a security procedure for the elevator may be performed according to a security level determined based on the identified stranger and/or the detected abnormal event.

In accordance with at least one embodiment, a method may be provided for performing an elevator security procedure according to a security level of an elevator of a building including a plurality of residence units through an elevator security system including home gateways respectively installed at the plurality of residence units and a server coupled to the home gateways. The method may include analyzing a comparison result of passenger information of passengers in the elevator and member information of members of residence units associated with floors selected by the passengers in the elevator, determining a security level of the elevator based on the analysis result, and performing a security procedure designated for the determined security level by controlling at least one of constituent elements of the elevator and smart devices coupled to the at least one of home gateways.

Prior to the analyzing, the method may further include receiving the passenger information from the elevator through a communication network and determining residence units associated with floors selected by passengers in the elevator based on the passenger information.

The method may include transmitting the received passenger information to home gateways of the determined residence units through a communication network and receiving the comparison result from the home gateways of the determined residence units through the communication network. The method may include transmitting a request to home gateways of the determined residence units to provide member information, receiving the member information from the home gateways of the determined residence units, and comparing the passenger information and the member information.

The passenger information may include a shoe size, a shoe shape, a shoe outsole pattern, a weight, a moving direction, a selected floor to travel, a footstep pattern, an activity, a sound, of each passenger in the elevator. The passenger information may be sensed and collected by a plurality of sensors of the elevator.

The member information may include identification, a shoe size, a shoe shape, a shoe outsole pattern, a weight, a height, an eye color, a hair color, a footstep pattern, a voice tone, a time of come-in, a time of go-out, a current in/out status, a coming home pattern, and a going out pattern of each member. The member information of each member of a respective residence unit may be sensed and collected by a plurality of smart devices coupled to the home gateways.

The analyzing a comparison result may include identifying a stranger among the passengers in the elevator based on the comparison result.

The method may include analyzing the passenger information including a monitoring result of monitoring activities of the passengers in the elevator and determining whether an abnormal event occurs in the elevator based on the analysis result.

The abnormal event may be determined to occur when the monitoring result includes information on a measured pressure level higher than a predetermined pressure level, when the monitoring result includes information on a measured sound level higher than a predetermined sound level, when the monitoring result includes information on an identified stranger not getting off the elevator on a floor selected by the identified stranger, and when the monitoring result includes information on the identified stranger included in a wanted person list.

The determining a security level may include determining a security level as a normal level when all of the passengers is identified as members of the associated residence units based on the analysis result, determining a security level as an intermediate level when at least one of the passengers is identified as a stranger based on the analysis result, and determining a security level as a high level when an abnormal event is occurring in the elevator by a result of analyzing the passenger information.

When the determined security level is a normal level, the performing a security procedure may include controlling home gateways of residence units associated with the passengers to output an informing message at the associated residence units and controlling at least one of constituent elements of the elevator to transmit captured images to the home gateways of the associated residence units. The information message may be one of a voice message and a text message that informs of related members that a passenger is in an elevator.

When the determined security level is an intermediate level, the performing a security procedure may include controlling at least one constituent element to output a warning message inside the elevator, transmitting an informing message with information on a detected stranger to home gateways of residence unites associated with the passengers in the elevator, and transmitting captured images to the home gateways of the associated residence units.

When the determined security level is a high level, the performing a security procedure may include sounding an alarm and outputting a warning message through at least one constituent element inside elevator, transmitting an informing message with information on identified strangers to home gateways of residence units associated with the passengers in the elevator, transmitting captured images to the home gateways of the associated residence units, and controlling the elevator to stop and/or to open or close a door of the elevator.

The performing a security procedure may further include transmitting an informing message with information on the identified strangers to at least one of a related security office and a related police station and transmitting captured images in real time to the at least one of the security office and the police station.

In accordance with another embodiment, a method may be provided for performing an elevator security procedure according to a security level of an elevator of a building including a plurality of residence units through an elevator security system including home gateways respectively installed at the plurality of residence units and a server coupled to the home gateways. The method may include collecting passenger information upon generation of a predetermined event, transmitting the collected passenger information to the server through a communication network, receiving a control signal from the server, and controlling constituent elements based on the control signal.

The collecting may include sensing, the passenger information, at least one of a shoe size, a shoe shape, a shoe outsole pattern, a weight, a moving direction, a selected floor to travel, a footstep pattern, an activity, a sound, of each passenger in the elevator through a plurality of sensors of the elevator.

The controlling may include receiving a warning message from the server through a communication network and outputting the received warning message through at least one of a speaker and a monitor.

In accordance with still another embodiment, a method may be provided for performing an elevator security procedure according to a security level of an elevator of a building including a plurality of residence units through an elevator security system including home gateways respectively installed at the plurality of residence units and a server coupled to the home gateways. The method may include collecting member information through at least one of smart devices coupled to a same home network, upon generation of a predetermined event, storing and managing the collected member information of members of a corresponding residence unit, receiving passenger information from the server through a communication network, comparing the received passenger information and the stored member information to identify members of the corresponding residence unit among the passengers in the elevator, and transmitting the comparison result to the server.

The method may include receiving a control signal to perform a security procedure designated for a security level of the elevator, and controlling at least one of smart devices coupled to a same home network in response to the control signal.

The controlling may include controlling at least one smart device to output an informing message associated with an identified member in the elevator and controlling at least one smart device to display real-time image of an inside of the elevator.

BRIEF DESCRIPTION OF THE DRAWINGS

The above and/or other aspects of the present invention will become apparent and more readily appreciated from the following description of embodiments, taken in conjunction with the accompanying drawings, of which.

DESCRIPTION OF EMBODIMENTS

Figure 1:
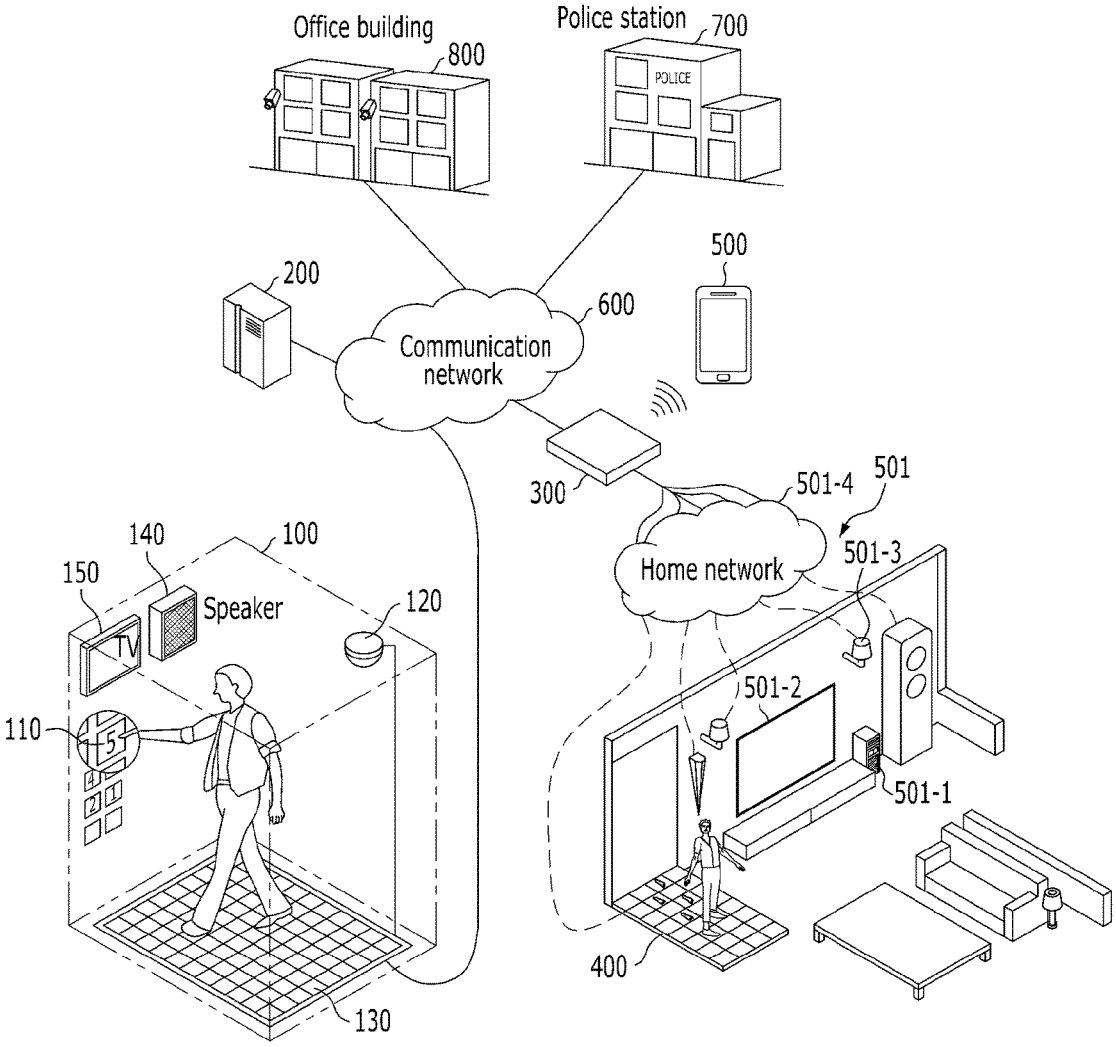
FIG. 1 illustrates an elevator security system in accordance with at least one embodiment.

Reference will now be made in detail to embodiments of the present invention, examples of which are illustrated in the accompanying drawings, wherein like reference numerals refer to like elements throughout. The embodiments are described below, in order to explain the present invention by referring to the figures.

In accordance with at least one embodiment, a person may be automatically identified when the person enters into a predetermined area, the identified person may be monitored in real time, the monitoring result may be informed of associated persons. Such an area may be any enclosed area including an elevator, a room, a bathroom, and so forth. In this specification, an elevator will be described as an enclosed area for describing at least one embodiment of the present invention, but the present invention is not limited thereto.

In accordance with at least one embodiment, when a person enters into an elevator, a floor selected by the person may be detected. Upon the detection, information on the selected floor may be obtained, residence units or office units associated with the selected floor may be determined, information on the determined residence units or offices may be obtained, persons related to the determined residence units or office units may be determined, information on the determined persons may be obtained, the person entering into the elevator may be automatically identified based on the obtained information on the determined persons associated with the residence units and office unites, and the identifying results may be reported. Based on the determined persons associated with the residence units and office units and the identified person entering into the elevator, various types of operations may be performed to protect the associated persons such as family members from crimes.

FIG. 1 illustrates an elevator security system in accordance with at least one embodiment. Referring to FIG. 1, an elevator security system may identify the person entering into and/or activities occurring at an elevator, monitor the identified person and/or activities, and perform a security procedure based on the monitoring result, for example, providing the monitoring result to associated persons in real time, in accordance with at least one embodiment. Such an elevator security system may include elevator 100 including information collector 130, server 200, and home gateway 300 including informatory collector 400.

Elevator 100 is a type of vertical transport equipment powered by electric motors that efficiently moves people or goods between floors (e.g., levels or decks) of a building (e.g., an apartment building or an office building. Such elevator 100 may include control panel 110, security camera 120, information collector 130, speaker 140, and display 150.

Control panel 110 may be an interface that enables a user to control elevator 100. For example, control panel 110 may include control buttons for selecting a floor to travel, buttons for communication with a designated person (e.g., emergency contact), buttons for closing/opening a door of elevator 100, buttons for stopping elevator 100, and so forth. Control panel 110 may further include a voice recognition function to detect a voice instruction from a person (e.g., passenger) entering elevator 100 and to control elevator 100 in response to the detected voice instruction. For example, control panel 110 may detect a voice instruction for selecting a floor to travel and control elevator 100 to travel to the selected floor. The present invention, however, is not limited thereto.

Control panel 110 may store and/or transmit information on interaction with a passenger to a designated external device through communication network 600. For example, control panel 110 may include a memory for storing the information on interaction with a passenger in a predetermined memory and/or include a communication circuit for transmitting the information on interaction to server 200 or user equipment 500 through communication network 600.

Furthermore, control panel 110 may be coupled to other constituent elements (e.g., security camera 120, information collector 130, speaker 140, and display 150) and control the constituent elements in response to a control signal from at least one of server 200, home gateway 300, user equipment 500, and a passenger. For example, control panel 110 may receive a control signal from server 200, home gateway 300, or user equipment 500 for performing a security procedure which is determined based on a result of monitoring the inside of elevator 100. Control panel 110 may receive sensing information from the constituent elements such as security camera 120 and information collector 130 and transmit the received sensing information to at least one of server 200, home gateway 300, and user equipment 500. The present invention, however, is not limited thereto. For example, each one of constituent element may include a processor and a communication circuit, which are configured to receive a control signal directly from at least one of server 200, home gateway 300, and user equipment 500 and to perform a predetermined operation, and configured to collect sensing information and to transmit the collected sensing information to at least one of server 200, home gateway 300, and user equipment 500. When an emergency event occurs inside elevator 100, control panel 110 may transmit a monitoring result and information on interaction with passengers to designated contacts, such as police station 700 and security office 800.

Security camera 120 may capture images (e.g., still image or moving image) of persons and activities inside elevator 100 and transmit the captured image to at least one of server 200, home gateway 300, and user equipment 500. Security camera 120 may store the captured images in a predetermined memory. Security camera 120 may include a audio recording device (e.g., microphone) to record voice and sound generated inside elevator 100. Security camera 120 may include a closed-circuit television (CCTV) and an Internet protocol (IP) camera.

Security camera 120 may transmit the captured images or the recorded voice and sound to control panel 110 and/or external devices coupled with elevator 100 through communication network 600. For example, security camera 120 may transmit the recorded images, voice, and sound to control panel 110, but the present invention is limited thereto. Security camera 120 may transmit the recorded images, voice, and sound to server 200, home gateway 300 of residence or office units associated with a floor selected by a passenger, and/or user equipment 500 designated by the associated residence or office units. In addition, security camera 120 may transmit the recorded images, voice, and/or sound to policy station 700 or security office 800, which are designated by the associated residence units or office units.

Information collector 130 may collect information on passengers and activities occurring inside elevator 100 in accordance with at least one embodiment. For example, information collector 130 may include various sensors and be installed at a floor of elevator 100, as a footstep sensor to sense a person entering into elevator 100 and movement of the person inside elevator 100. In accordance with at least one embodiment, information collector 130 may include at least one sensor and automatically sense and collect predetermined information on persons and activities thereof. For example, information collector 130 may include at least one sensor and collect passenger information through the at least one sensor. That is, information collector 130 may include a plurality of sensors for improving precession. The plurality of sensors may include a footstep sensor configured to sense footsteps of a passenger and a moving direction of footsteps, a weight sensor configured to measure a weight of an object (e.g., passenger), a pressure sensor configured to measure a pressure applied on a floor of elevator 100, such as a footstep made by a passenger, an image sensor configured to capture a predetermined image such as an image of a footstep, a temperature sensor (e.g., thermometer), a sound sensor (e.g., audiometer) and so forth.

In particular, i) information collector 130 may collect information of at least one passenger of elevator 100, referred to as passenger information. The passenger information of each passenger may include information on a shoe size, a shoe shape, a shoe outsole pattern, a weight of a passenger, a moving direction, a selected floor, a footstep pattern, an activity, a sound, and so forth. ii) Information collector 130 may collect information on events, referred to as event information, occurring inside elevator 100 using a plurality of types of sensors. For example, the event information may include a pressure level of pressure applied on a floor of elevator 100, a sound level of voice or sound generating inside elevator 100, a floor selected by a passenger inside elevator 100, and information whether a passenger exits from elevator 100 on an associated selected floor. Such event information may be used to determine whether an emergence event (e.g., abnormal event) is occurring inside elevator 100.

For example, when a pressure applied on a floor of elevator 100 is greater than a predetermined pressure level and when sound detected inside elevator 100 is greater than a predetermined sound level, such an event may be determined as an abnormal event or an emergency event because such event might be fighting or attacking. When one of passengers inside elevator 100 does not exit from elevator 100 at a floor selected by an associated passenger, such an event may be determined as an abnormal event or an emergency event because the passenger may have other purposes to use elevator 100 except travelling to the selected floor (e.g., robbery other passengers or sexually attack other passengers).

Information collector 130 may transmit the collected passenger information to an external device through a communication network. For example, the collected passenger information may be transmitted directly to at least one of server 200, home gateway 300 of a residence or office unit associated with a selected floor of a passenger, and user equipment 500 designated by a residence or office unit associated with a selected floor of a passenger through communication network 600. The collected passenger information may be transmitted to server 200 and server 200 may transmit the collected passenger information to home gateway 300 of a residence or office unit associated with a selected floor.

In order to communication, information collector 130 may include a communication circuit (not shown) for transmitting and receiving information to an external device through communication network 600. The communication circuit may be coupled to an external device through a wired network or a wireless network, for example, a power line communication (PLC), a local area network (LAN), a value added network (VAN), a wide area network (WAN), a Bluetooth, a Wi-Fi, and a WI-Max.

Such a communication circuit may transmit collected passenger information of passengers to an external device. For example, the communication circuit may transmit the collected passenger information to home gateway 300 of a residence unit or an office unit associated with a selected floor by a passenger. In particular, when a passenger selects a fifth floor through control panel 110 as shown in FIG. 1, the communication circuit transmits collected passenger information to home gateways (e.g., home gateway 300) of residence units 501 or 502, which are associated with the selected floor, the fifth floor. The communication circuit may not transmit the collected passenger information to residence units not associated with the selected floor, such as residence units 601, 702, and so forth.

The communication circuit of information collector 130 may transmit information sensed by other constituent elements, such as camera 120. For example, the communication circuit may transmit images captured by security camera 120 to server 200 or to home gateway 300 of a residence or office unit associated with a selected floor by a passenger. In addition, the communication circuit transmits the captured images to police station 700 and security office 800 designated by the associated residence or office units. Such captures images may be transmitted in real time to a designated destination when an abnormal event or an emergency event is detected.

Furthermore, the communication circuit of information collector 130 may receive a control signal from server 200. For example, the communication circuit receives a control signal from server 200 to output an informing message through a predetermined device (e.g., speaker 140 and display 150). In this case, the communication circuit delivers the received control signal to speaker 140 and display 150. The communication circuit receives a control signal to stop elevator 100 and a control signal to open or close a door of elevator 100 and delivers the received control signal to control panel 110 to control elevator 100 and the door thereof.

The communication circuit was described as being included in the image collector 130, but the present invention is not limited thereto. The communication circuit may be included in other constituent elements, such as control panel 110, to transmit associated information to an external device or receiving signals from an external device.

Elevator 100 may include speaker 140 and display 150 for outputting informing messages and warning messages. That is, speaker 140 and display 150 output a warning message or an informing message to passengers in elevator 100 in order to warn or inform the passengers of an emergency situation. For example, when a stranger or an illegal intruder is detected in elevator 100, speaker 140 outputs a voice message for informing or warning of passengers in elevator 100, such as "the elevator is in recording." When an emergency event or an abnormal event is detected inside elevator 100, speaker 140 may play back a predetermined sound to warn passengers and display 150 may display a predetermined message. Such speaker 140 and display 150 may be coupled to at least one of server 200, home gateway 300, and user equipment 500 through communication network 600 and controlled by at least one of server 200, home gateway 300, and user equipment 500. Alternatively, speaker 140 and display 150 may be controlled by control panel 110.

Server 200 may manage and control an operation for determining a security mode based on a monitoring result and performing a security procedure based on the determined security mode. Such server 200 may be coupled to elevator 100 through communication network 600. For example, server 200 may be a computing system that communicates with elevator 100, home gateways, and user equipment through communication network 600 and installed at the same building where elevator 100 is installed.

In accordance with at least one embodiment, server 200 may receive passenger information collected by at least one of information collector 130, control panel 110, and security camera 120. Then, server 200 may transmit the received passenger information to home gateways of the associated residence units or office units. In particular, server 200 receives information on a floor selected by a passenger, determine residence or office units associated with the selected floor, and transmit the collected passenger information to home gateways of the determined residence or office units.

Server 200 may receive a comparison result of comparing passenger information and member information, from a home gateway. That is, server 200 may receive a comparison result of comparing passengers in elevator 100 with registered members of the residence or office units associated with floors selected by passengers. Server 200 may analyze the comparison result and determine a security level of elevator 100. For example, based on the comparison result, server 200 identifies a stranger or an intruder among the passengers and decides a security level of elevator 100 based on the identified stranger and activities thereof.

For example, when all of passengers in elevator 100 are identified as registered members of associated residence or office units, server 200 determines a security level of elevator 100 is a normal level and control constituent elements in a normal level. When at least one of passengers in elevator 100 is identified as a stranger or an intruder, server 200 may determine a security level of elevator 100 as an intermediate level and control constituent elements to perform a security procedure designated for an intermediate level. However, when the identified stranger is an expected visitor or a scheduled visitor, server 200 determines a security level of elevator 100 as a normal level.

Server 200 was described as transmitting the passenger information to and receiving the comparison result from home gateways associated with residence units or office units associated with floors selected by passengers in elevators, but the present invention is not limited thereto. For example, instead of transmitting the passenger information, server 200 may request the associated home gateways to provide registered member information. In this case, server 200 receives the member information from the associated home gateways, compares the passenger information and the member information, and determines a security level of elevator 100 by analyzing the comparison result.

In accordance with at least one embodiment, server 200 may detect activities or events occurring inside elevator 100 based on the monitoring result and the comparison result and determine a security level based on the detected event. As described, the monitoring result is a result of sensing passengers using information collector 130, security camera 120, and control panel 110. The comparison result is a result of comparing passenger information and registered member information.

For example, server 200 receives information on activities occurring inside elevator 100, as a monitoring result, from at least one of control panel 110, security camera 120, and information collector 130 and analyzes the received information. Based on the analysis result, server 200 may determine a security level of elevator 100. That is, when the analysis result indicates an abnormal event, server 200 determines a current security level of elevator 100 as a high level and performs a security procedure designated for the high level. The abnormal event may be determined when a physical fight is detected or a sound of screaming is detected. Such a physical fight or the sound of screaming may be detected through sensors included in information collector 130 and security camera 120. That is, information collector 130 collects pressure applied on a floor of elevator 100 by passengers and sound generated inside elevator 100 through a microphone included in security camera 120 in elevator 100. When the collected pressure level and sound level are greater than a respective predetermined level, server 200 determines that the abnormal event occurs.

Furthermore, when an identified stranger or intruder does not get off elevator 100 on an associated selected floor, server 200 may determine a security level of elevator 100 as a high level. In this case, server 200 performs a security procedure designated for the high level. That is, server 200 decides a security level based on a result of analyzing events or activities occurring inside elevator 100 as well as information on passengers.

For example, in a normal level, server 200 may, as a security procedure, i) control home gateways associated with passengers of elevator 100 to output an informing message at associated residence units and ii) control at least one of control panel 110, security camera 120, and information collector 130 to transmit captured images to the home gateways of the associated residence units. The information message may be a voice message or a text message that informs of related members that a passenger is in an elevator and will be home shortly. Such a message may be output through at least one of smart devices (e.g., speaker 501-1 and smart TV 501-2) controlled by an associated home gateway (e.g., home gateway 300).

In an intermediate level, server 200 may, as a security procedure, i) control speaker 140 and/or monitor 150 to output a warning message inside elevator 100, ii) transmit an informing message with information on a detected stranger to home gateways of associated residence unites, and iii) transmit captured images to home gateways of associated residence units.

In a high level, server 200 may, as a security procedure, i) sound an alarm and outputs a warning message through speaker 140 and/or monitor 150 inside elevator 100, ii) transmit an informing message with information on a stranger to home gateways of associated units, iii) transmit captured images to home gateways of associated units, and iv) control elevator 100 to stop elevator 100 and/or to open or close a door of elevator 100.

In the high level, server 200 may iv) transmit an informing message with information on a stranger to at least one of security office 800 and police station 700 and v) transmit captured images in real time to the at least one of security office 800 and police station 700. In this way, security office 800 or police station 700 may monitor the inside of elevator 100 in real time.

Home gateway 300 may be installed at each unit (e.g., residence unit or office unit in a building where elevator 100 is installed). Home gateway 300 may form smart network 501-4 in a corresponding unit. Home gateway 300 may connect smart network 501-4 (e.g., local area network (LAN)) to a wide area network (WAN) and control a plurality of smart devices participating in a smart home network. For example, smart speaker 501-1, smart TV 501-2, smart light 501-3, and information collector 400 may be coupled to home gateway 300 through home network 501-4 and controlled by home gateway 300 in order to provide a smart home service.

Such home gateway 300 may transmit information to and receive information from an external device (e.g., server 200, security office 800, and police station 700) through communication network 600. Furthermore, home gateway 300 may communication with registered smart devices, such as user equipment 500 (e.g., a smart phone, a smart pad, a laptop computer, a tablet PC) smart TV 501-2, smart speaker 501-1, smart light 501-3, a smart heating system, and a smart air condition.

In particular, home gateway 300 may collect information on members of each unit (e.g., family members of a corresponding residence unit) through registered smart devices.

Home gateway 300 may store such collected information as member information. Furthermore, home gateway 300 may provide the member information to server 200 in response to a request from server 200. The member information may be used to identify a stranger or an intruder entering into elevator 100. The member information may include information on each member of a corresponding unit, such as identification, a shoe size, a shoe shape, a shoe outsole pattern, a weight, a height, an eye color, a hair color, a footstep pattern, a voice tone, a time of come-in, a time of go-out, a coming home pattern, a going out pattern, a current in/out status, and so forth. In accordance with at least one embodiment, home gateway 300 may include information collector 400 to collect information on members of a corresponding unit.

For example, information collector 400 of home gateway 300 is installed under a predetermined area (e.g., an entrance area) of a floor of a corresponding residence unit (e.g., unit 501). Information collector 400 collects information on each member of a corresponding unit and transmits the collected member information to home gateway 300. In particular, information collector 400 automatically collects information on a member when the member enters into (e.g., coming home) and exiting from (e.g., going out) a corresponding unit (e.g., residence unit 501).

As described, information collector 400 may include a plurality of sensors. The plurality of sensors may include a footstep sensor configured to sense footsteps of a passenger and a moving direction of footsteps, a weight sensor configured to measure a weight of an object (e.g., passenger), a pressure sensor configured to measure a pressure applied on a floor of elevator 100, such as a footstep made by a passenger, an image sensor configured to capture a predetermined image such as an image of a footstep, a temperature sensor (e.g., thermometer), a sound sensor (e.g., audiometer) and so forth.

In particular, information collector 400 may automatically collect member information including a shoe size, a shoe shape, a shoe outsole pattern, a weight, a height, an eye color, a hair color, a footstep pattern, a voice tone, a time of come-in, a time of go-out of each member, and so forth. Furthermore, information collector 400 may detect movement of a member to determine whether the member is entering into or going out. For example, when the detected movement is a movement toward to a front door of a corresponding unit and opening of the front door is detected, information collector 400 may determine a corresponding member is going out. When opening of the front door is detected and then the detected movement is a movement toward to an inside of a corresponding unit, information collector 400 may determine a corresponding member is exiting out. In addition, information collector 400 may measure a time of coming home and a time of going out and determine a coming home pattern and a going out pattern_of each member, as well as the member information of each member.

Home gateway 300 may transmit information to and receive information from server 200 and information collector 130 of elevator 100 through communication network 600. In particular, home gateway 300 may receive passenger information of passengers in elevator 100 from server 200 or directly from elevator 100. Home gateway 300 may receive image of inside elevator 100 directly from elevator 100 or through server 200.

Home gateway 300 may compare passenger information of passengers in elevator 100 and member information of residence or office units associated with the passengers. For example, home gateway 300 receives the passenger information from elevator 100 through server 200 and compares the received passenger information with member information of the registered members of associated residence or office units. Home gateway 300 may transmit the comparison result to server 200, but the present invention is not limited thereto. For example, based on the comparison result, home gateway 300 may determine whether all of the passengers are the registered members or any strangers are included in the passengers in elevator 100. That is, each member is identified based on the comparison result. Upon the detection of a member, home gateway 300 may output an informing message to inform other members in a corresponding unit that the detected member is in elevator 100. Furthermore, home gateway 300 may transmit the determination result (e.g., information on the identified members) to server 200.

In accordance with at least one embodiment, home gateway 300 may store and manage member information on registered members of each residence or office unit. In particular, home gateway 300 may detect a member, movement of the detected member (e.g., entering into or going out), a time of coming in or going out, a come-in pattern, a go-out pattern, and so forth. Such detection may be stored and managed by each registered member and updated whenever new movement is detected.

In accordance with at least one embodiment, home gateway 300 may store and manage information on visitors (e.g., past visitors and/or scheduled visitors). In particular, home gateway 300 detects a visitor, movement of the detected visitor (e.g., come in or go out), a time of visiting or leaving, a visiting pattern or a leaving pattern, and so forth. Such detection may be stored and managed by each visitor.

For example, when a united parcel service (UPS) delivery is scheduled to visit or when a Pizza delivery is scheduled to visit, home gateway 300 may store and manage such scheduled visit information. Home gateway 300 obtains information on a scheduled visitor using various smart devices including user equipment 500 (e.g., smart phone) coupled to home gateway 300. The obtained information on a scheduled visitor may be stored and managed by each visitor.

In more particular, home gateway 300 may collect call history or text messages from a smart phone of registered members and detect a scheduled visitor. In case of a UPS delivery, a smart phone may receive a text message for informing a delivery from a UPS truck. Such collection of information may be used to detect a scheduled visitor. As another example, when any member of a residence or office unit orders a food using a smart phone, such information may be transmitted to home gateway 300 and detect a scheduled visitor. Furthermore, when any member of a residence or office unit makes a call, a telephone number thereof may be transmitted to server 200 through home gateway 300. Server 200 may determine whether the telephone number is a restaurant's telephone number of not. If so, server 200 may predict a food delivery is scheduled to visit. Accordingly, server 200 may determine a distance to the restaurant and a time of making a call and predict a scheduled visitor based on the determination result.

Home gateway 300 compares passenger information of passengers and member information of corresponding units and transmits the comparison result to server 200. Furthermore, home gateway 300 may transmit the comparison result and captured images to user equipment 500. In accordance with at least one embodiment, when one of members is determined as entering into elevator 100, home gateway 300 may transmit an informing message and a captured image to various types of smart devices in a corresponding unit, such as user equipment 400, a smart phone, a wall mounted monitor, and so forth.

As described, server 200 may be coupled to home gateway 300 and elevator 100, determine a security level of elevator 100 based on information received from home gateway 300 and elevator 100, and perform a security procedure based on the determined security level. Such server 200 will be described with reference to FIG. 2.

Figure 2:
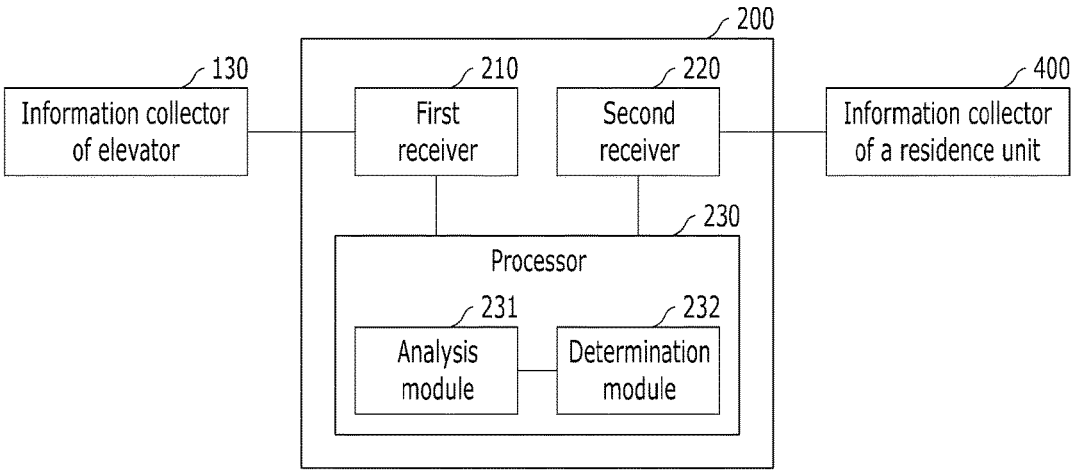
FIG. 2 illustrates a server for performing a security procedure according to a security level of an elevator in accordance with at least one embodiment.

FIG. 2 illustrates a server for performing a security procedure according to a security level of an elevator in accordance with at least one embodiment.

Referring to FIG. 2, server 200 may be coupled to information collector 130 of elevator 100 through communication network 600 and coupled to information collector 400 of a respective residence or office unit through a corresponding home gateway. Such sever 200 may include first receiver 210, second receiver 220, and process 230. Furthermore, processor 230 may include analysis module 231 and determination module 232.

First receiver 210 may receive passenger information on passengers in elevator 100 from information collector 130 of elevator 100. First receiver 210 may transfer the received passenger information to analysis module 213. First receiver 210 may receive a monitoring result of monitoring passengers inside elevator 100 in real time from elevator 100. First receiver 210 may transfer the monitoring result to processor 230. The monitoring result is described as being independent from the passenger information, but the present invention is not limited thereto. The passenger information may include the monitoring result and first receiver 210 may receive the passenger information in real time from elevator 100.

Second receiver 220 may receive member information on registered member of a corresponding unit (e.g., family members of a residence unit) from information collector 400 of the corresponding unit through a corresponding home gateway. Second receiver 220 may transfer the received member information to processor 230. Second receiver 220 is described as receiving the member information from information collector 400, but the present invention is not limited thereto. In accordance with another embodiment, second receiver 220 may receive a comparison result from a corresponding home gateway. The comparison result may be a result of comparing the passenger information and the member information.

Processor 230 may receive the passenger information from first receiver 210 and the member information from second receiver 220. Processor 230 may compare the passenger information with the member information and identify members and intruders among the passengers in elevator 100 based on the comparison result. Furthermore, processor 230 may analyze the monitoring result in the passenger information and determine whether an abnormal event is occurring in elevator 100 based on the analysis result.

Processor 230 may determine a security level of elevator 100 based on the comparison result (e.g., stranger) and the determination result (e.g., abnormal event) and performs a security operation according to the determined security level. For example. processor 230 determines a security level of elevator 100 is a normal level when all of passengers are identified as registered members. Processor 230 determines a security level of elevator 100 is an intermediate level when at least one of passengers is identified as a stranger or an intruder. Processor 230 determines a security level of elevator 100 is a high level i) when at least one of passenger is identified as a stranger or an intruder, and/or when an abnormal event is occurring in elevator 100. Processor 230 determines that the abnormal even is occurring i) when pressure applied on a floor of elevator 100 is greater than a predetermined level, ii) when detected sound has a sound level greater than a predetermined level, iii) when the identified stranger does not get off elevator 100 on a floor selected by the identified stranger, iv) when the identified stranger is included in a list of wanted persons from an associated organization such as policy station 700, and so forth.

Based on the determined security level, processor 230 performs a corresponding security procedure by controlling related elements as follows. For example, in a normal level, server 200 may i) control home gateways associated with passengers of elevator 100 to output an informing message at associated residence units and ii) control at least one of control panel 110, security camera 120, and information collector 130 to transmit captured images to the home gateways of the associated residence units. The information message may be a voice message or a text message that informs of related members that a passenger is in an elevator and will be home shortly. Such a message may be output through at least one of smart devices (e.g., speaker 501-1 and smart TV 501-2) controlled by an associated home gateway (e.g., home gateway 300). In an intermediate level, server 200 may, as a security procedure, i) control speaker 140 and/or monitor 150 to output a warning message inside elevator 100, ii) transmit an informing message with information on a detected stranger to home gateways of associated residence unites, and iii) transmit captured images to home gateways of associated residence units.

In a high level, server 200 may, as a security procedure, i) sound an alarm and outputs a warning message through speaker 140 and/or monitor 150 inside elevator 100, ii) transmit an informing message with information on a stranger to home gateways of associated units, iii) transmit captured images to home gateways of associated units, and iv) control elevator 100 to stop elevator 100 and/or to open or close a door of elevator 100. In the high level, server 200 may v) transmit an informing message with information on a stranger to at least one of security office 800 and police station 700 and vi) transmit captured images in real time to the at least one of security office 800 and police station 700. In this way, security office 800 or police station 700 may monitor the inside of elevator 100 in real time.

Server 200 was described as a stand-alone computing device independent from other entities, such as control panel 110 and home gateway 300, but the present invention is not limited thereto. That is, server 200 may be included in control panel 110 or home gateway 300 in accordance with another embodiment.

Furthermore, server 200 was described as including first and second receivers 210 and 220 and processor 230, independent from other entities, but the present invention is not limited thereto. For example, first and second receivers 210 and 220 of server 200 may be distributed in other entities. In particular, second receiver 1200 may be installed at home gateway 300. Processor 230 may be installed at home gateway 300.

Hereinafter, an overall operation of an elevator security system will be described with reference to FIG. 3. For convenience and ease of understanding, an elevator security system for monitoring an elevator in a residence building including a plurality of residence units, but the present invention is not limited thereto. For example, such an elevator security system may perform similar operation for other buildings including a plurality of units, such as an office building including a plurality of office units.

Figure 3:
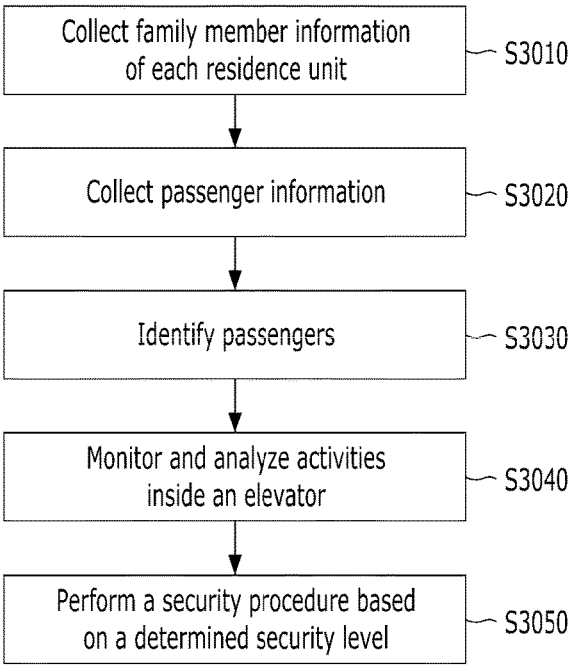
FIG. 3 illustrates an overall operation of an elevator security system in accordance with at least one embodiment.

FIG. 3 illustrates an overall operation of an elevator security system in accordance with at least one embodiment.

Referring to FIG. 3, family member information of each residence unit may be collected at step S3010. For example, home gateway 300 of each residence unit (e.g., residence unit #501 in FIG. 1) may collect family member information of each family member through smart devices 501-1 to 501-4 and information collector 400. As described, information collector 400 may include a plurality of different types of sensors. The plurality of sensors may include a footstep sensor configured to sense footsteps of a family member and a moving direction of footsteps, a weight sensor configured to measure a weight of a family member, a pressure sensor configured to measure a pressure applied on a floor, such as a footstep made by a family member, an image sensor configured to capture a predetermined image such as an image of a footstep, a temperature sensor (e.g., thermometer), a sound sensor (e.g., audiometer) and so forth. Based on the collected information, each family member may be registered at home gateway 300 with the collected family member information. Such collected family member information may be stored in mapping relation with a corresponding family member.

Furthermore, such family member information may be automatically and continuously collected to update the family member information and/or to add new family member information for newly detected family member. The family member information may include information on each member of a corresponding unit, such as identification, a shoe size, a shoe shape, a shoe outsole pattern, a weight, a height, an eye color, a hair color, a footstep pattern, a voice tone, a time of come-in, a time of go-out, a coming home pattern and a going out pattern and so forth. After collecting, home gateway 300 may store the collected family member information in a memory included in home gateway 300 or coupled to home gateway 300 through home network 501-4. However, the present invention is not limited thereto. The collected family member information may be transmitted to server 200 through communication network 600.

At step S3020, passenger information may be collected. For example, control panel 110, security camera 120, and information collector 130 of elevator 100 may collect information on passengers upon generation of a predetermined event. The predetermined event may include detecting a person entering elevator 100 or receiving a control signal to initiate a collecting operation. Control panel 110, security camera 120, and information collector 130 may further collect information on events or activities occurring inside elevator 100. In order to detect such passenger information and event information, information collector 130 may include a plurality of sensors for collecting various types of information. The plurality of sensors may include a footstep sensor, a weight sensor, a pressure sensor, an image sensor, a temperature sensor (e.g., thermometer), a sound sensor (e.g., audiometer) and so forth.

At step S3030, passengers may be identified. For example, such an identifying operation may be performed by server 200 and/or at least one of home gateways of residence units associated with floors selected by passengers. Such an identification procedure may be performed by one of server 200 and respective home gateway 300. In case of performing the identifying operation in each home gateway of residence units associated with floors selected by passengers, i) server 200 may receive the passenger information from elevator 100 and transmit the passenger information to home gateways associated with floors selected by passengers, and ii) the home gateways compare the passenger information with the member information, identify registered members from the passengers, and transmit the identifying result as the comparison result to server 200.

In case of performing the identifying operation in server 200, i) server 200 may receive the passenger information from elevator 100, ii) request home gateways associated with floors selected by the passengers to provide member information, iii) receive member information from the associated home gateway, iv) compare the passenger information and the member information, and v) identify members from the passengers.

At step S3040, an inside of elevator 100 may be monitored and events or activities occurring inside elevator 100 may be analyzed based on the monitoring result. For example, sever 200 may continuously receive the passenger information including the monitoring result in real time and determine whether any abnormal event is occurring in elevator 100. The abnormal event may be determined i) when a detected pressure level is greater than a predetermined pressure level, ii) when a detected sound level is greater than a predetermined sound level, iii) when an identified stranger does not get off elevator 100 on a floor selected by the identified stranger, and iv) when an identified stranger is in a list of wanted persons, published by a related organization, such as the policy department.

At step S3050, a security level may be determined and a security procedure designated to the determined security level may be performed. For example, server 200 may determine a security level based on the comparison result and the monitoring result and perform a security procedure designated by the determined security level. The security level may include a normal level, an intermediate level, and a high level. The security level may be determined as follows. When all of passengers are identified as members of related units, the security level is determined as a normal level. When at least one of passengers is identified as a stranger or an intruder, the security level is determined as an intermediate level. When at least one of passengers is identified as a stranger and when an abnormal event is occurring inside elevator 100, the security level is determined as a high level.

Based on the determined security level, server 200 may perform a security procedure as follows. For example, in a normal level, server 200 may, as a security procedure, i) control home gateways associated with passengers of elevator 100 to output an informing message at associated residence units and ii) control at least one of control panel 110, security camera 120, and information collector 130 to transmit captured images to the home gateways of the associated residence units. The information message may be a voice message or a text message that informs of related members that a passenger is in an elevator and will be home shortly. Such a message may be output through at least one of smart devices (e.g., speaker 501-1 and smart TV 501-2) controlled by an associated home gateway (e.g., home gateway 300). In an intermediate level, server 200 may, as a security procedure, i) control speaker 140 and/or monitor 150 to output a warning message inside elevator 100, ii) transmit an informing message with information on a detected stranger to home gateways of associated residence unites, and iii) transmit captured images to home gateways of associated residence units.

In a high level, server 200 may, as a security procedure, i) sound an alarm and outputs a warning message through speaker 140 and/or monitor 150 inside elevator 100, ii)

transmit an informing message with information on a stranger to home gateways of associated units, iii) transmit captured images to home gateways of associated units, and iv) control elevator 100 to stop elevator 100 and/or to open or close a door of elevator 100. In the high level, server 200 may iv) transmit an informing message with information on a stranger to at least one of security office 800 and police station 700 and v) transmit captured images in real time to the at least one of security office 800 and police station 700. In this way, security office 800 or police station 700 may monitor the inside of elevator 100 in real time.

Hereinafter, a security procedure performed based on identification of passengers of an elevator will be described with reference to FIG. 4. For convenience and ease of understanding, a security procedure for a residence building including a plurality of residence units, but the present invention is not limited thereto. For example, such a security procedure may be similar to that for other buildings including a plurality of units, such as an office building including a plurality of office units.

Figure 4:
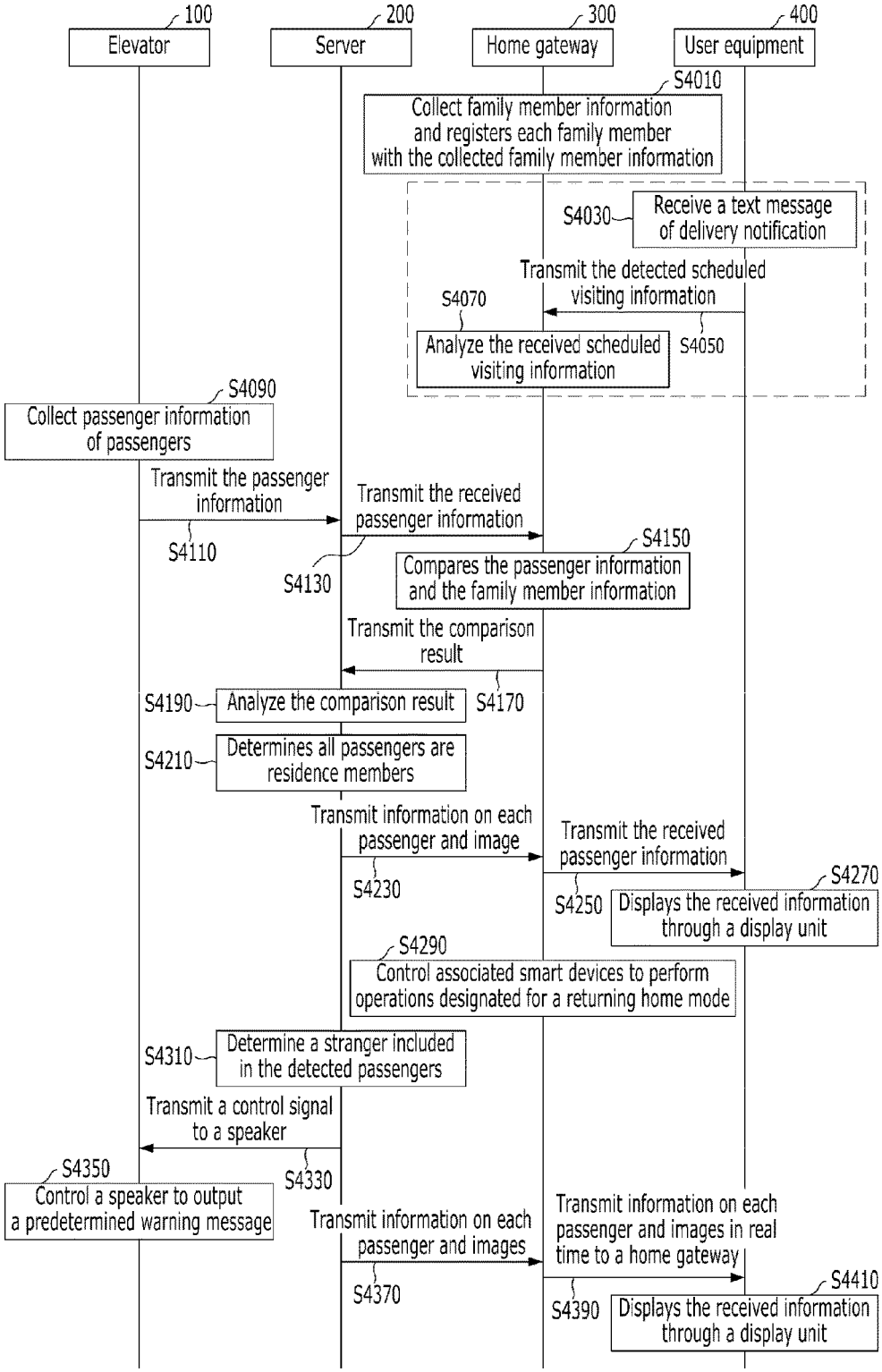
FIG. 4 illustrates a security procedure performed based on identification of passengers entering into an elevator in accordance with at least one embodiment.

FIG. 4 illustrates a security procedure performed based on identification of passengers entering into an elevator in accordance with at least one embodiment.

Referring to FIG. 4, at step S4010, home gateway 300 collects family member information of each family member of a respective residence unit and registers (e.g., stores) each family member with the collected family member information. Such a collecting and registering procedure may be automatically and continuously performed to periodically update the family member information, to add new family member, and/or to update a current status of each family member. The family member information may include information on a shoe size, a shoe shape, a shoe outsole pattern, a weight, a footstep pattern, a current status (e.g., an in-home status or an out-home status), a come-in pattern, a go-out pattern, and so forth.

Home gateway 300 may collect scheduled visiting information from a plurality of smart devices coupled to and managed by home gateway 300. For example, a text message, a voice call, or a voice message from a predetermined caller (e.g., a deliver company) may be detected as information on a scheduled visit and transmitted to home gateway 300.

At step S4030, user equipment 100 receives a text message of delivery notification from a united parcel service (UPS) or a united state post service (USPS) and detects the received text message as scheduled visiting information. At step S4050, user equipment 100 transmits the detected scheduled visiting information (e.g., the received text message) to home gateway 300. At step S4070, home gateway 300 analyzes the received scheduled visiting information and stores the received scheduled visiting information.

In FIG. 4, the scheduled visiting information collecting procedure steps S4030 to S4070 is illustrated as being performed after the collecting and registering procedure S4010, but the present invention is not limited thereto. For example, the scheduled visiting information collection procedure steps S4030 to S4060 may be performed before the collecting and registering procedure S4010. Alternatively, the scheduled visiting information collection procedure steps S4030 to S4070 and the collecting and registering procedure step S4010 may be performed at the same time.

At step S4090, elevator 100 collects passenger information of passengers. For example, when a passenger enters elevator 100, elevator 100 collects information on the passenger through control panel 110, security camera 120, and information collector 130. That is, elevator 100 collects information on the passenger and monitors activities of the passenger in real time.

At step S4110, elevator 100 transmits the passenger information to server 200. The passenger information may include a monitoring result of monitoring activities of the passenger. At step S4130, server 200 transmits the received passenger information to home gateway 300. Server 200 determines residence units associated with passengers based on floors selected by the passengers and transmits the received passenger information to home gateways (e.g., home gateway 300) of the determined residence units.

At step S4150, home gateway 300 compares the passenger information and the family member information to determine whether the registered members are included in the passengers. That is, home gateway 300 identifies registered family members from the passengers.

At step S4170, home gateway 300 transmits the comparison result to server 200. The comparison result may be the identifying result. At step S4190, server 200 analyzes the comparison results from related residence units.

When server 200 determines all passengers are registered members at step S4210, server 200 may determine a security level of elevator 100 as a normal level and perform a security procedure as follows. For example, server 200 transmits passenger information on each passenger and captured images in real time to home gateway 300 at step S4230, and home gateway 300 transmits the passenger information on each passenger and the captured images in real time to user equipment 500 at step S4250. At step S4270, user equipment 500 displays the received information and images through a display unit. At step S4290, home gateway 300 may control associated smart devices to perform operations designated for a returning home mode (e.g., a normal level).

When server 200 identifies at least one stranger among the passengers at step S4310, server 200 may determine a security level of elevator 100 as an intermediate level and perform a security procedure as follows. At step S4330, server 200 transmits a control signal to designated output devices of elevator 100, such as speaker 140 and monitor 150. At step S4350, elevator 100 receives the control signal and controls speaker 140 and monitor 150 to output a predetermined warning message. At step S4370, server 200 transmits passenger information on each passenger and captured images in real time to home gateway 300. At step S4390, home gateway 300 transmits the passenger information on each passenger and the captured images in real time to user equipment 500. At step S4410, user equipment 500 displays the received information through a display unit.

Hereinafter, a security procedure performed based on determination of events occurring inside an elevator will be described with reference to FIG. 5. For convenience and ease of understanding, a security procedure for a residence building including a plurality of residence units, but the present invention is not limited thereto. For example, such a security procedure may be similar to that for other buildings including a plurality of units, such as an office building including a plurality of office units.

Figure 5:
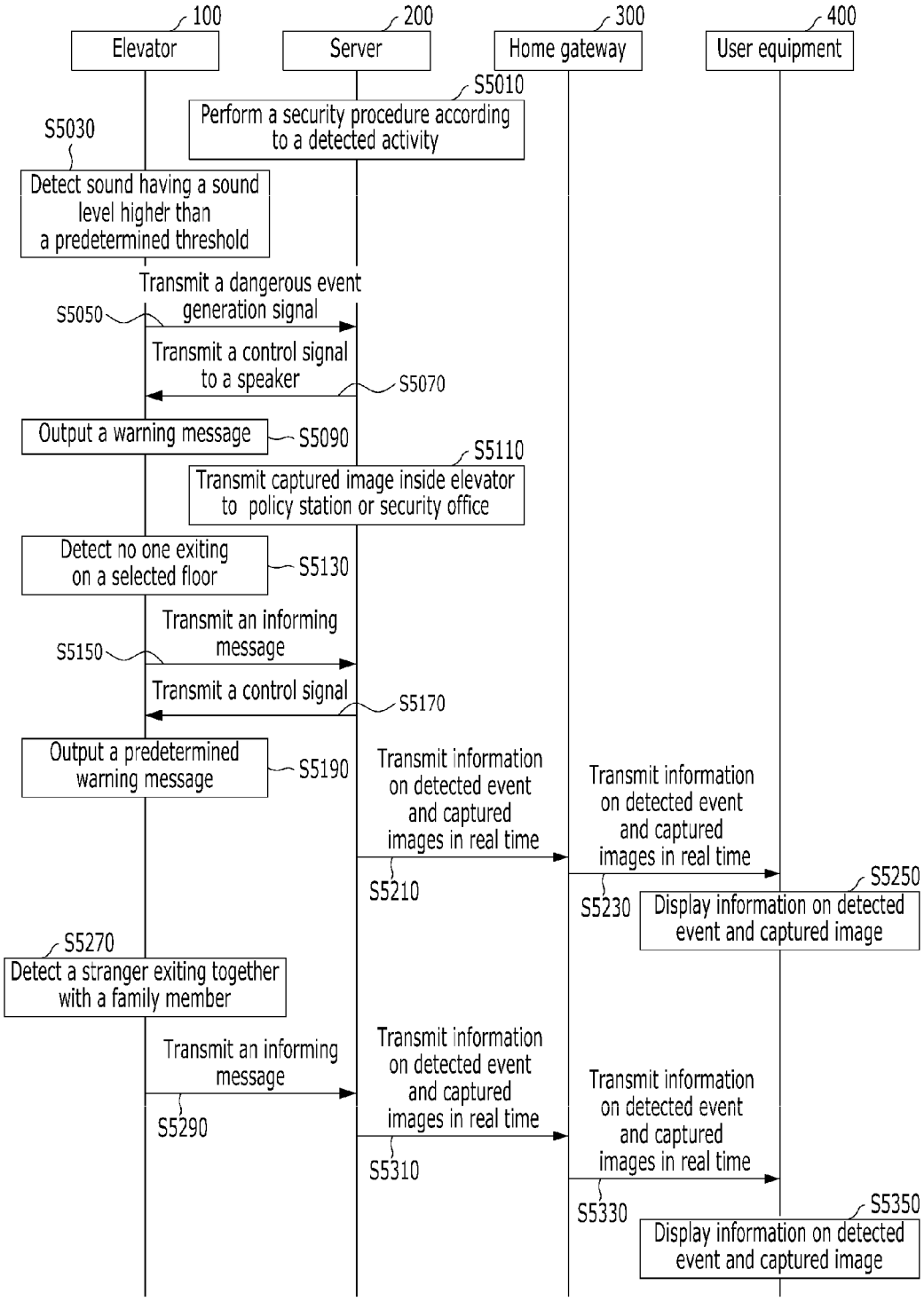
FIG. 5 illustrates a security procedure performed based on activities or events occurring into an elevator in accordance with at least one embodiment.

FIG. 5 illustrates a security procedure performed based on activities or events occurring into an elevator in accordance with at least one embodiment.

Referring to FIG. 5, server 100 may determine a security level of elevator 100 according to a detected event occurring inside elevator 100 and perform a security procedure based on the determined security level at step S5010. When elevator 100 detects a sound having a sound level higher than a predetermined threshold at step S5030, elevator 100 transmits an abnormal event generation signal to server 200 at step S5050. In response to the abnormal event generation signal, server 200 determines a security level of elevator 100 as a high level and transmits a control signal to a speaker to output a warning message at step S5070. In response to the control signal, elevator 100 outputs the warning message through the speaker at step S5090 and server 200 transmits captured images of passengers inside elevator 100 to policy station 800 or security office 700 at step S5110.

When no one gets off on a floor selected at least one passenger at step S5130, elevator 100 transmits an abnormal event generation signal to sever 200 at step S5150. In response to the abnormal event generation signal, server 200 determines a security level of elevator 100 as a high level and transmits a control signal to a speaker to output a warning message at step S5170. In response to the control signal, elevator 100 outputs the warning message through the speaker at step S5190. At step S5210, server 200 transmits information on detected event and captured images in real time to home gateway 300, which is related to one of passengers in elevator 100. At step S5230, home gateway 300 transmits information on detected event and captured images in real time to user equipment 500. At step S5250, user equipment 500 displays information on detected event and captured image.

When elevator 100 detects a stranger getting off elevator 100 with a registered family member at step S5270, elevator 100 transmits an informing message on such detection to server 200. At step S5310, server 200 determines a security level of elevator 100 as a high level and transmits information on detected event and captured images in real time to home gateway 300 associated with the family member. At step S5330, home gateway 300 transmits information on detected event and captured images in real time to user equipment 500. At step S5350, user equipment 500 displays information on detected event and captured image through a display.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Moreover, the terms "system," "component," "module," "interface,", "model" or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

The present invention can be embodied in the form of methods and apparatuses for practicing those methods. The present invention can also be embodied in the form of program code embodied in tangible media, non-transitory media, such as magnetic recording media, optical recording media, solid state memory, floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits. The present invention can also be embodied in the form of a bitstream or other sequence of signal values electrically or optically transmitted through a medium, stored magnetic-field variations in a magnetic recording medium, etc., generated using a method and/or an apparatus of the present invention.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

As used herein in reference to an element and a standard, the term "compatible" means that the element communicates with other elements in a manner wholly or partially specified by the standard, and would be recognized by other elements as sufficiently capable of communicating with the other elements in the manner specified by the standard. The compatible element does not need to operate internally in a manner specified by the standard.

No claim element herein is to be construed under the provisions of 35 U.S.C. §112, sixth paragraph, unless the element is expressly recited using the phrase "means for" or "step for."

Although embodiments of the present invention have been described herein, it should be understood that the foregoing embodiments and advantages are merely examples and are not to be construed as limiting the present invention or the scope of the claims. Numerous other modifications and embodiments can be devised by those skilled in the art that will fall within the spirit and scope of the principles of this disclosure, and the present teaching can also be readily applied to other types of apparatuses. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of performing an elevator security procedure according to a security level of an elevator of a building including a plurality of residence units through an elevator security system including home gateways respectively installed at the plurality of residence units and a server coupled to the home gateways, the method comprising:

analyzing a comparison result of passenger information of passengers in the elevator and member information of members of residence units associated with floors selected by the passengers in the elevator;

determining a security level of the elevator based on the analysis result; and performing a security procedure designated for the determined security level by controlling at least one of constituent elements of the elevator and smart devices coupled to the at least one of home gateways, wherein the method comprises:

analyzing the passenger information including a monitoring result of monitoring activities of the passengers in the elevator; and determining whether an abnormal event occurs in the elevator based on the analysis result and wherein the abnormal event is determined to occur when the monitoring result includes information on a measured pressure level higher than a predetermined pressure level, when the monitoring result includes information on a measured sound level higher than a predetermined sound level, when the monitoring result includes information on an identified stranger not getting off the elevator on a floor selected by the identified stranger, and when the monitoring result includes information on the identified stranger included in a wanted person list.

2. The method of claim 1, prior to the analyzing, further comprising:

receiving the passenger information from the elevator through a communication network; and determining residence units associated with floors selected by passengers in the elevator based on the passenger information.

3. The method of claim 2, comprising:

transmitting the received passenger information to home gateways of the determined residence units through a communication network;

receiving the comparison result from the home gateways of the determined residence units through the communication network; and determining whether the passengers of the elevator are the members of the residence units based on the received comparison result.

4. The method of claim 2, comprising:

transmitting a request home gateways of the determined residence units to provide member information;

receiving the member information from the home gateways of the determined residence units; and determining whether the passengers of the elevator are the members of the residence units by comparing the passenger information and the member information.

5. The method of claim 1, wherein:

the passenger information includes a shoe size, a shoe shape, a shoe outsole pattern, a weight, a moving direction, a selected floor to travel, a footstep pattern, an activity, a sound, of each passenger in the elevator; and the passenger information is sensed and collected by a plurality of sensors of the elevator.

6. The method of claim 1, wherein:

the member information includes identification, a shoe size, a shoe shape, a shoe outsole pattern, a weight, a height, an eye color, a hair color, a footstep pattern, a voice tone, a time of come-in, a time of go-out, a current in/out status, a coming home pattern, and a going out pattern of each member; and the member information of each member of a respective residence unit is sensed and collected by a plurality of smart devices coupled to the home gateways.

7. The method of claim 1, wherein the analyzing a comparison result comprises:

identifying a stranger among the passengers in the elevator based on the comparison result.

8. The method of claim 1, wherein the determining a security level comprises:

determining a security level as a normal level when all of the passengers is identified as members of the associated residence units based on the analysis result;

determining a security level as an intermediate level when at least one of the passengers is identified as a stranger based on the analysis result;

determining a security level as a high level when an abnormal event is occurring in the elevator by a result of analyzing the passenger information; and performing the security procedure designated for the determined one among the normal level, the intermediate level, and the high level.

9. The method of claim 1, wherein the performing a security procedure comprises, when the determined security level is a normal level:

controlling home gateways of residence units associated with the passengers to output an informing message at the associated residence units and controlling at least one of constituent elements of the elevator to transmit captured images to the home gateways of the associated residence units, wherein the information message is one of a voice message and a text message that informs of related members that a passenger is in an elevator.

10. The method of claim 1, wherein the performing a security procedure comprises, when the determined security level is an intermediate level;

controlling at least one constituent element to output a warning message inside the elevator 100;

transmitting an informing message with information on a detected stranger to home gateways of residence unites associated with the passengers in the elevator;

transmitting captured images to the home gateways of the associated residence units.

11. The method of claim 1, wherein the performing a security procedure comprises, when the determined security level is a high level;

sounding an alarm and outputting a warning message through at least one constituent element inside elevator;

transmitting an informing message with information on identified strangers to home gateways of residence units associated with the passengers in the elevator;

transmitting captured images to the home gateways of the associated residence units; and controlling the elevator to stop and/or to open or close a door of the elevator.

12. The method of claim 11, wherein the performing a security procedure further comprises:

transmitting an informing message with information on the identified strangers to at least one of a related security office and a related police station; and transmitting captured images in real time to the at least one of the security office and the police station.

13. A method of performing an elevator security procedure according to a security level of an elevator of a building including a plurality of residence units through an elevator security system including home gateways respectively installed at the plurality of residence units and a server coupled to the home gateways, the method comprising:

collecting passenger information upon generation of a predetermined event;

transmitting the collected passenger information to the server through a communication network;

receiving a control signal from the server; and controlling constituent elements based on the control signal, wherein the method comprises:

analyzing the collected passenger information including a monitoring result of monitoring activities of the passengers in the elevator; and determining whether an abnormal event occurs in the elevator based on the analysis result and wherein the abnormal event is determined to occur when the monitoring result includes information on a measured pressure level higher than a predetermined pressure level, when the monitoring result includes information on a measured sound level higher than a predetermined sound level, when the monitoring result includes information on an identified stranger not getting off the elevator on a floor selected by the identified stranger, and when the monitoring result includes information on the identified stranger included in a wanted person list.

14. The method of claim 13, wherein the collecting comprises:

sensing, the passenger information, at least one of a shoe size, a shoe shape, a shoe outsole pattern, a weight, a moving direction, a selected floor to travel, a footstep pattern, an activity, a sound, of each passenger in the elevator through a plurality of sensors of the elevator.

15. The method of claim 13, wherein the controlling comprises:

receiving a warning message from the server through a communication network; and outputting the received warning message through at least one of a speaker and a monitor.

16. A method of performing an elevator security procedure according to a security level of an elevator of a building including a plurality of residence units through an elevator security system including home gateways respectively installed at the plurality of residence units and a server coupled to the home gateways, the method comprising:

collecting member information through at least one of smart devices coupled to a same home network, upon generation of a predetermined event;

storing and managing the collected member information of members of a corresponding residence unit;

receiving passenger information from the server through a communication network;

comparing the received passenger information and the stored member information to identify members of the corresponding residence unit among the passengers in the elevator; and transmitting the comparison result to the server, wherein the method comprises:

analyzing the passenger information including a monitoring result of monitoring activities of the passengers in the elevator; and determining whether an abnormal event occurs in the elevator based on the analysis result and wherein the abnormal event is determined to occur when the monitoring result includes information on a measured pressure level higher than a predetermined pressure level, when the monitoring result includes information on a measured sound level higher than a predetermined sound level, when the monitoring result includes information on an identified stranger not getting off the elevator on a floor selected by the identified stranger, and when the monitoring result includes information on the identified stranger included in a wanted person list.

17. The method of claim 16, comprising:

receiving a control signal to perform a security procedure designated for a security level of the elevator;

controlling at least one of smart devices coupled to a same home network in response to the control signal.

18. The method of claim 16, wherein the controlling comprises:

controlling at least one smart device to output an informing message associated with an identified member in the elevator; and controlling at least one smart device to display real-time image of an inside of the elevator.

* * * * *